US005895139A

United States Patent [19]

Osaka et al.

[11] Patent Number: 5,895,139

[45] Date of Patent: Apr. 20, 1999

[54] IMAGE FORMING DEVICE WITH A PRINTER UNIT AND A COPYING UNIT

[75] Inventors: Toshiyuki Osaka; Yasuyuki Hirai; Tetsuro Kawashima; Yoshihiro Ueda; Hideki Takeda; Takeshi Okuda; Makoto Okado; Yoshiyuki Takeda; Tsutomu Sugaya, all of Osaka, Japan

[73] Assignee: Mita Industrial Co., Ltd., Osaka, Japan

[21] Appl. No.: 08/865,144

[22] Filed: May 29, 1997

[30] Foreign Application Priority Data

| | | | |
|---|---|---|---|
| May 31, 1996 | [JP] | Japan | 8-139337 |
| May 31, 1996 | [JP] | Japan | 8-160620 |
| May 31, 1996 | [JP] | Japan | 8-160621 |

[51] Int. Cl.[6] ..... G03G 15/22

[52] U.S. Cl. ..... 399/2; 399/139; 399/367

[58] Field of Search ..... 399/1, 2, 145, 399/365, 368, 363, 367, 139

[56] References Cited

U.S. PATENT DOCUMENTS

| | | | |
|---|---|---|---|
| 4,794,419 | 12/1988 | Shibazaki et al. | 399/1 |
| 5,771,419 | 6/1998 | Kubo et al. | 399/2 |

*Primary Examiner*—S. Lee

*Attorney, Agent, or Firm*—Shinjyu An Intellectual Property Firm

[57] ABSTRACT

An image forming device connected to one or more data processing devices is disclosed, and includes a printer unit, a copying unit, a document transport unit for transporting documents printed in the printer unit to a document mounting unit on the copying unit, and a guide member for moving the printer unit between a first position adjacent to the document mounting unit on the copying unit and a second position separated from the document mounting unit. The data processing device sends print jobs to the printer unit, and if multiple copies are desired, the printed documents are sent to the copying unit by the document transport device and copied.

13 Claims, 17 Drawing Sheets

S61
RECEIVE IMAGE PROCESS CONTROL DATA
S62
DOCUMENTS ON DOCUMENT MOUTING UNIT?
NO
YES
S63
DISCHARGE DOCUMENTS
S64
DATA RECEPTION PROHIBITED
S65
DOCUMENT TRANSPORT COMPLETE?
NO
YES
S66
"COPYING IN PROGRESS" SIGNAL
S67
DOCUMENT DISCHARGE PATH
S68
COPYING OPERATION
S69
COPYING COMPLETED?
NO
YES
S70
"COPYING COMPLETED" SIGNAL / DATA RECEPTION ALLOWED

IMAGE FORMING DEVICE WITH A PRINTER UNIT AND A COPYING UNIT

BACKGROUND OF THE INVENTION

1. Field of the Invention

The present invention generally relates to an image forming device. More specifically, the present invention relates to an image forming device connected to a data processing device, and equipped with a printer unit, a copying unit which makes copies of the documents printed in the printer unit, and a document transport device for transporting printed documents from the printer unit to the copying unit.

2. Description of the Related Art Printers which print out character and image data sent from data processing devices such as personal computers are widely known. One problem with these types of printers has been that a significant amount of time is needed to print a large number of copies, especially when compared with the time that it takes a copying machine to do the same job.

An image forming device which attempts to solve this problem is disclosed in Japanese Unexamined Patent Application No. 5-107987 (1995). This image forming device is a combination of a copying unit and a printer unit, and is connected to a data processing device. The image data output from the data processing device is printed out by the printer unit, and the printed documents are then transported to an document mounting unit on the copying unit. The documents on the document mounting unit are then sequentially transported to a document reading unit, and then read and copied as instructed. Because the documents printed in the printer unit are used as the originals in the copying unit, a large number of copies can be made at a relatively high speed.

In this image forming device, the direction in which the paper is transported in the printer unit is the same as the direction in which documents are transported from the document mounting unit of the copying unit to the document reading unit. The printed documents are discharged from the printer unit and then transported to the document mounting unit in the copying unit.

Generally speaking, the size of printers which use A4-sized paper can be reduced if the A4-sized sheets are transported through the printer in the longitudinal direction, i.e., along the length of the A4 sheet. This is because the image forming unit (such as the photosensitive drum) need only be as long as the width of the A4 sheet. In addition, there are large numbers of copying machines capable of forming images on paper up to A3 size, thus the length of the image forming unit in the copying machine need only be as long as the with of an A3 sheet (which is the same as the length of an A4 sheet). When an A4 sheet is used in this type of copying machine, it can be transported through the copying machine along its width and thus increase the copying efficiency of the copying machine.

However, in the above-described image forming device which combines a printer unit with a copying unit, A4 size documents are both transported through the printer unit and discharged to the document mounting unit of the copying unit in the lengthwise direction. As a result, the efficiency of the image forming process is lowered because these documents are transported through the copying unit in the lengthwise direction, even though the image forming unit in the copying unit is capable of processing A4 size documents along their width. In addition, because the printer unit discharges documents to the original mounting unit of the copying unit in the lengthwise direction, the overall length of the image forming device is large. This makes it difficult to produce a compact image forming device.

Accordingly, it has been proposed to transport a sheet of paper through the printer unit in a first direction (for example, along the length of an A4 sheet), and then transport it in a second direction (for example, along the width of an A4 sheet) and align the documents on the document mounting unit in the copying unit. The leading and trailing edges of the documents (with respect to the second direction) on the document mounting unit can be readily aligned, however it is difficult to align the right and left edges of the documents. If the documents are fed through the copying unit in this condition, there is a risk that a paper jam may occur, or that the images formed may be positionally shifted.

In addition, because the first direction and the second direction are different, separate drive sources are required. For example, it is conceivable that two motors are arranged such that their drive directions are perpendicular to each other. This has the effect of increasing the overall size and cost of the image forming device, as well as its power consumption.

SUMMARY OF THE INVENTION

One object of the present invention is to provide an image forming device capable of forming a large number of images at a high speed with a high degree of efficiency, in response to image data output from a data processing device such as a personal computer.

Another object of the present invention is to provide an image forming device capable of properly transporting documents between two image forming units.

Yet another object of the present invention is to provide an image forming device equipped with two sets of document transport means which transport documents in different directions by means of a simple drive unit.

According to one aspect of the present invention, an image forming device is connected to at least one data processing device capable of processing image data and image process control data. The image forming device includes a printer unit for printing documents based on the image data while transporting the documents in a first direction, a document stacking means for sequentially discharging and stacking the documents to a document stacking unit after being printed, a first document transport means for transporting the documents in the document stacking unit in a second direction different from the first direction and aligning the documents at a document mounting unit, a second document transport means for sequentially transporting the documents on the document mounting unit in the second direction to a document reading unit, and a copying unit for reading image data from the documents transported to the document reading unit, and forming copies of the documents in accordance with the image process control data output from the data processing device.

According to another aspect of the present invention, the first direction in which the documents are transported in the printer unit corresponds to a length of the documents, and the second direction in which the documents are transported by the first document transport means and said second document transport means corresponds to a width of the documents.

According to yet another aspect of the present invention, the first document transport means sequentially transports documents from the document stacking unit in an order opposite that which the second document transport means sequentially transports documents from the document mounting unit.

According to yet another aspect of the present invention, the document stacking means stacks documents printed in the printer unit such that the image formed thereon is facing upward, the first document transport means sequentially transports documents from the document stacking unit to the document mounting unit from the uppermost document on the document stacking unit, and the second document transport means sequentially transports documents from the document mounting unit to the document reading unit from the lowermost document on the document mounting unit.

According to yet another aspect of the present invention, an image forming device includes a first image forming unit which prints documents while transporting the documents in a first direction, and a second image forming unit which copies images printed on the documents while transporting the documents in a second direction different from the first direction.

The image forming device further includes a document stacking unit for sequentially stacking documents discharged from the first image forming unit, a fixed position defining member disposed on an upstream side of the document stacking unit in the first direction for positionally defining the trailing edge of the documents in the first direction, a discharge member disposed a predetermined distance downstream from the fixed position defining member in the first discharge direction for discharging documents to the document stacking unit, a movable position defining member disposed downstream of the document stacking unit in the first direction for positionally defining a leading edge of the documents, a defining member driving means for moving the movable position defining member when documents are discharged by the discharge member, and a discharge mechanism for transporting documents from the document stacking unit to the second image forming unit in the second direction.

According to yet another aspect of the present invention, the movable position defining member is moved between a first position and a second position, the first position separated from the fixed position defining member by the length of the documents in the first direction, and the second position disposed downstream of the first position at a distance equal to a distance between the discharge member and the fixed position defining member in the first direction, and the defining member driving means places the movable position defining member at the second position when documents are discharged by the discharge member and places the movable position defining member at the first position after documents have been discharged from the discharge member.

According to yet another aspect of the present invention, the image forming device further includes a release roller which is placed on the documents discharged from the discharge member and rotated in the first direction when the documents are discharged from the discharge member.

According to yet another aspect of the present invention, the image forming device is connectable with at least one data processing device capable of processing image data and image process control data, the first image forming unit is a printer unit for printing documents in accordance with the image data output from the data processing device, and the second image forming unit is a copying unit which reads image data from documents transported from the printer unit and forms copies thereof in accordance with the image process control data output from the data processing device.

According to yet another aspect of the present invention, a motor drives the first document transport means and the second document transport means, and a drive force transferring means transfers the drive force of the motor to the first document transport means and the second document transport means.

According to yet another aspect of the present invention, when the drive force from the motor is transferred to one of the first document transport means or the second document transport means, the drive force transferring means does not transfer the drive force from the motor to the other of the first or second document transport means.

According to yet another aspect of the present invention, the motor is operable in both a forward and a reverse direction. When the motor is operated in the forward direction, the drive force transferring means transfers the drive force of the motor to one of the first or second transport means, and when said motor is operated in the reverse direction, the drive force transferring means transfers the drive force of the motor to the other of the first and second transport means.

Other objects, features, aspects and advantages of the present invention will be apparent from the following detailed description of the present invention when taken in conjunction with the accompanying drawings, in which like reference numerals designate the same or similar parts throughout.

DETAILED DESCRIPTION OF THE PREFERRED EMBODIMENTS

Figure 1:
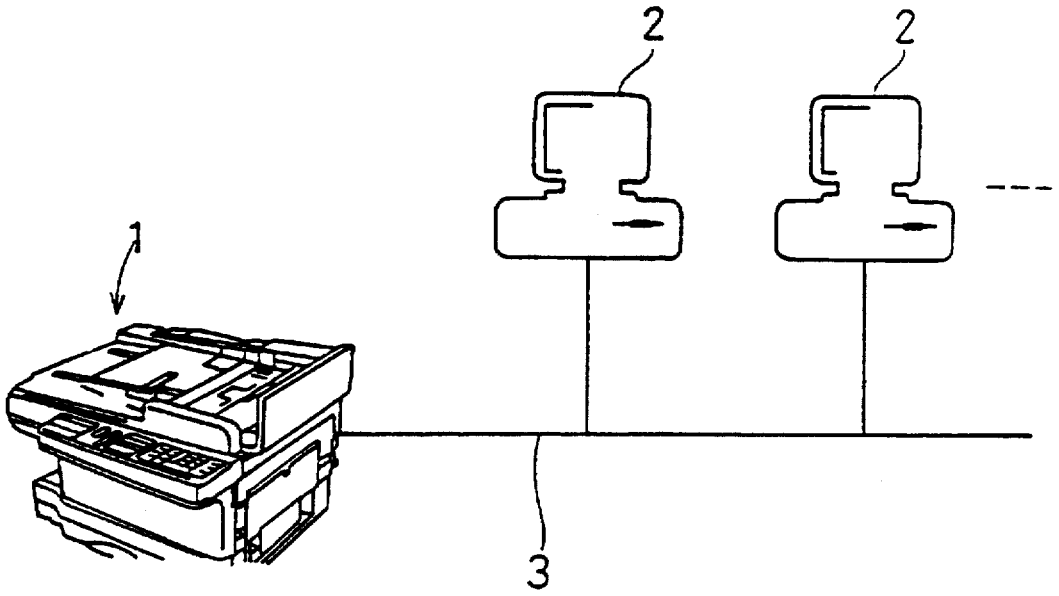
FIG. 1 shows a system which employs an image forming device according to one embodiment of the present invention.

FIG. 1 shows a system which employs an image forming device according to one embodiment of the present invention. An image forming device 1 may be connected to one or more data processing devices 2 via a communication line 3. The communication line 3 may be a LAN cable, a telephone line, or another type of communication line, and the data processing device 2 can be personal computers, network servers, or host computers. Each data processing device 2 can form, edit, input or output image data, as well as produce image processing control data, and send it to the image forming device 1. The image processing control data is used to instruct the image forming device 1 as to paper size, copy volume, and other image processing operations.

Figure 2:
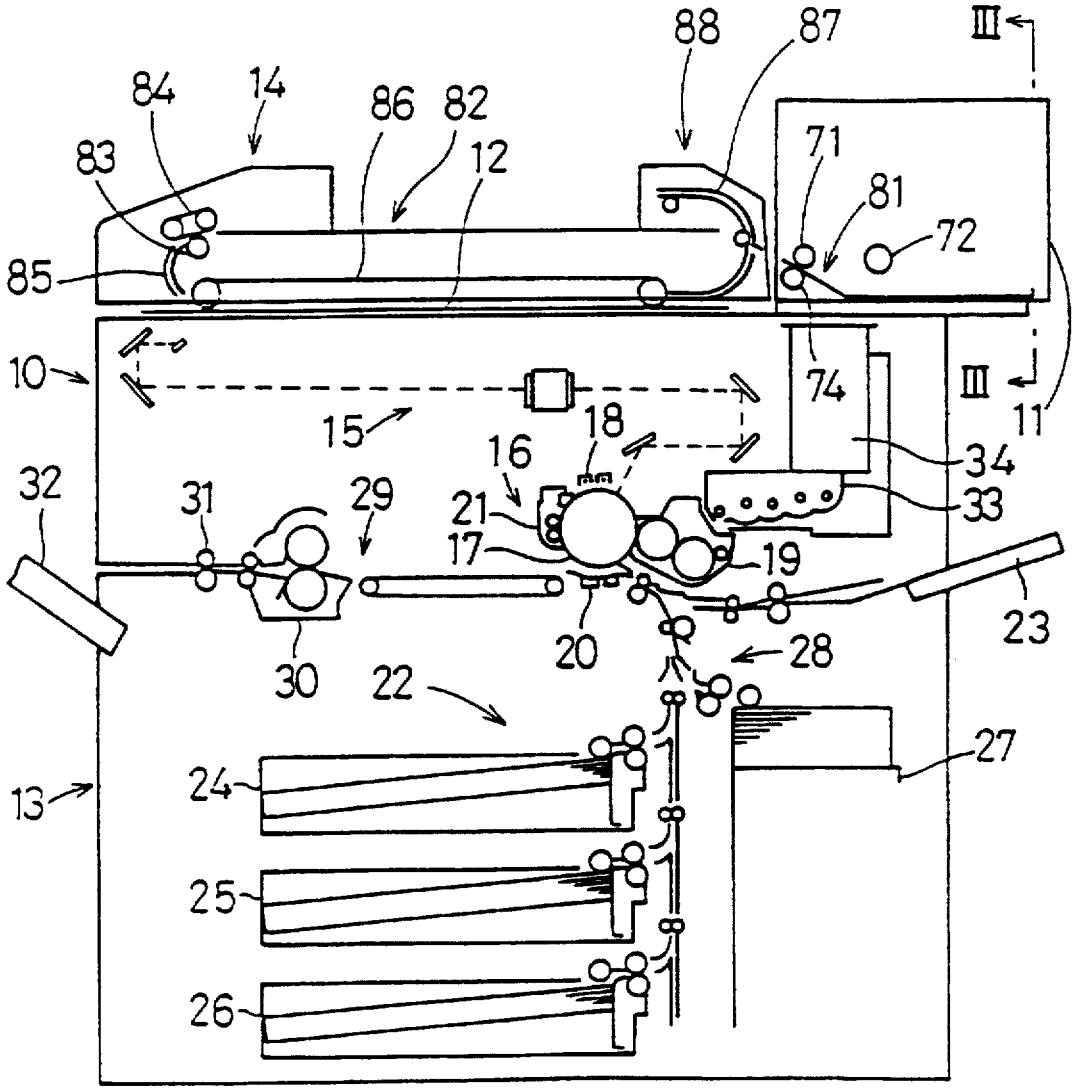
FIG. 2 is a schematic cross-sectional view of the image forming device depicted in FIG. 1.

As shown in FIG. 2, the image forming device 1 is equipped with a copying unit 10 and a printer unit 11. The copying unit 10 includes a copying unit main body 13, which includes a document reading unit 12 on an upper surface thereof where documents are mounted and read, and an document transport device 14 disposed above the copying unit main body 13. Inside the copying unit main body 13, an exposing unit 15 is provided for optically reading documents, and includes a light source, mirrors, a lens unit and the like. An image forming unit 16 is provided at a central portion of the copying machine main body 13, for forming a toner image of each optically read document. The image forming unit 16 includes a photosensitive drum 17 on which an electrostatic latent image is formed. A charging device 18, a developing device 19, a transfer/separating device 20, and a cleaning device 21 are arranged around the photosensitive drum 17.

A paper supply unit 22 is provided at a lower portion of the copying unit main body 13. The paper supply unit 22 includes a bypass table 23, paper supply cassettes 24, 25, and 26, a large-sized paper supply cassette 27, and a paper transport device 28 for transporting paper stored on the bypass table 23 or in the paper supply cassettes 24 to 27 to the image forming unit 16.

The downstream side of the image forming unit 16 includes a paper transport belt 29, a fixing device 30 for melting/fixing the toner image formed on a sheet of paper, a discharge roller 31 for discharging paper from the copying unit main body 13, and a paper tray 32 for storing the discharged documents.

A toner hopper 33 is mounted on a developing device 19, and a toner cartridge 34 is detachably mounted on the toner hopper 33.

Figure 3:
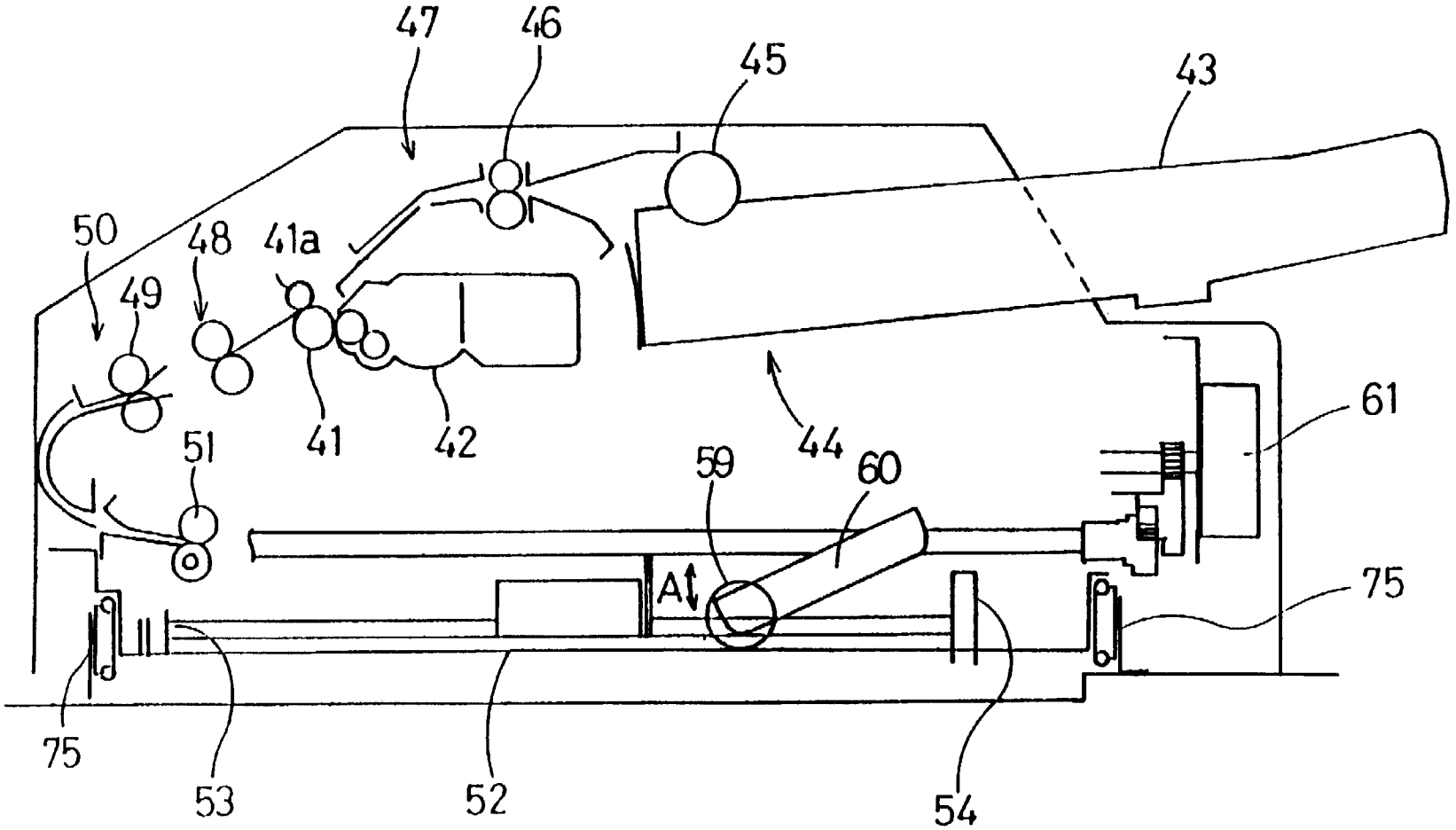
FIG. 3 is a schematic cross-sectional view of a printer unit disposed in the image forming device depicted in FIG. 2.

A detailed explanation of the printer unit 11 will now be made with reference to FIG. 3, which is a cross-sectional view taken along a line III—III shown in FIG. 2.

A photosensitive drum 41 is provided in the printer unit 11, and an electrostatic latent image is formed on the peripheral surface thereof in response to image data output from the data processing device 2. Disposed around the photosensitive drum 41 is a charger (not shown) for uniformly charging the photosensitive drum 41, a laser unit (not shown) for placing an electrostatic latent image onto the photosensitive drum 41, a developing device 42 for developing the electrostatic latent image on the photosensitive drum 41 to form a toner image, and a transfer roller 41*a*.

This embodiment employs a rear surface transfer system, in which a toner image is transferred to a lower surface of a sheet of paper supplied between the transfer roller 41*a* and the photosensitive drum 41. A paper supply unit 44 on which a paper supply cassette 43 is mounted is disposed on the upstream side (the right side as viewed in FIG. 3) of the photosensitive drum 41. A paper supply roller 45 is provided above the paper supply unit 44, and removes individual sheets of paper from the paper supply cassette 43. A paper supply path 47 is disposed between the paper supply roller 45 and the photosensitive drum 41, and includes a feed roller 46 for feeding paper from the paper supply cassette 43. The sizes of the paper stored in the paper supply cassette 43 should be smaller than, or equal to, A4 size, and the paper is stored therein such that the longitudinal direction of the paper is coincident with the direction the paper is transported.

A fixing device 48 is provided on the downstream side (the left side as viewed in FIG. 3) of the photosensitive drum 41, for melting and fixing a toner image formed on a sheet of paper. A discharge paper path 50 is provided on the downstream side of the fixing device 48, and includes a feed roller 49. An intermediate portion of the discharge paper path 50 is substantially U-shaped, and causes the direction of the paper fed from the fixing device 48 to be turned by 180 degrees and then transported downstream. An discharge roller 51 is provided further downstream of the discharge paper path 50.

A stacking tray 52 is disposed under the printer unit 11, and serves as a place where documents are stacked after being printed. A fixed position defining member 53 is provided on the stacking tray 52, and serves to align the trailing edges of the documents on the stacking tray 52. The fixed position defining member 53 is disposed on the stacking tray 52 at a predetermined distance upstream from the discharging roller 51.

Figure 4:
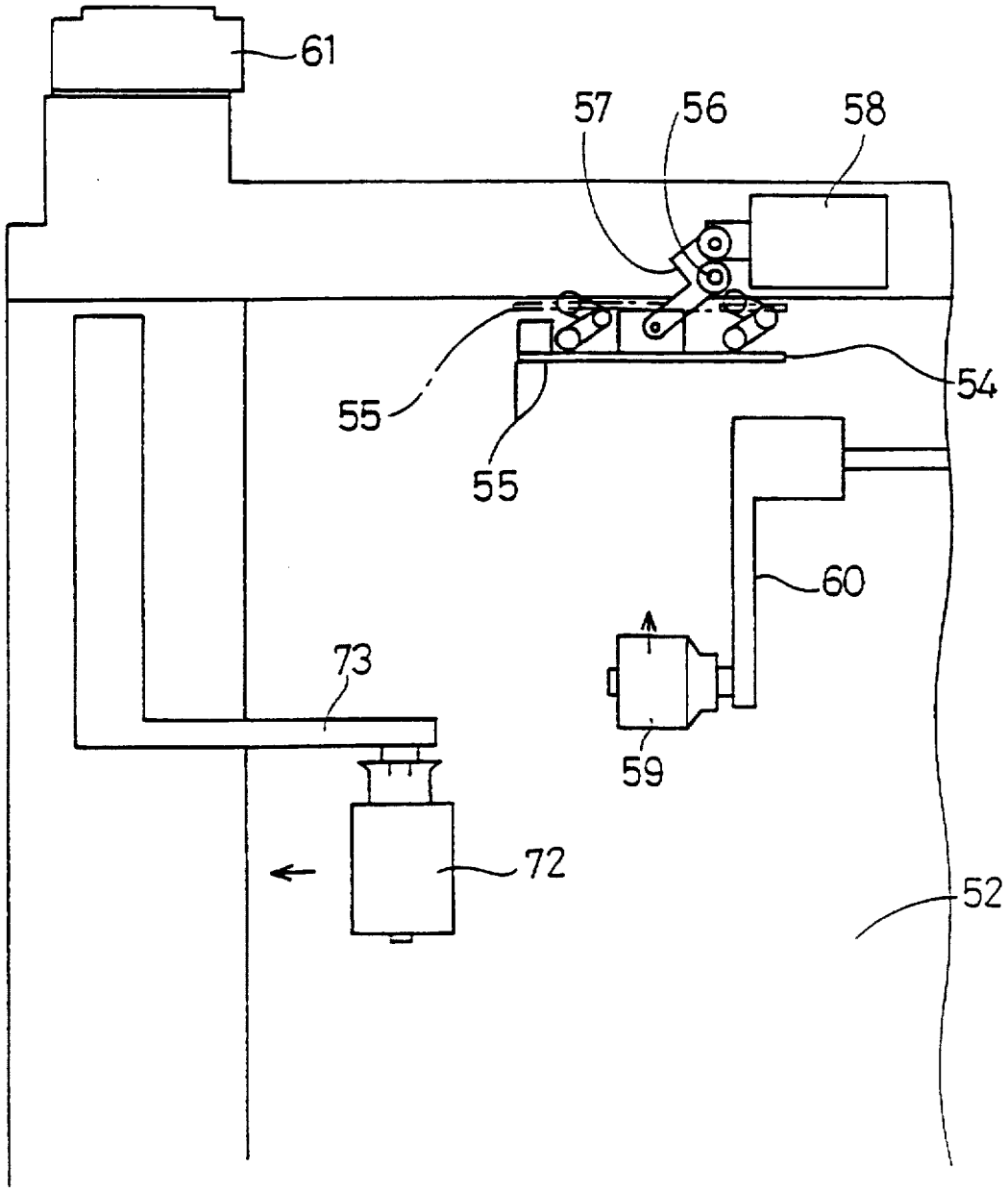
FIG. 4 is a transverse sectional view of the printer unit depicted in FIG. 3.

A movable position defining member 54 is provided on the downstream side of the stacking tray 52, and serves to align the leading edges of the documents stacked thereon. As illustrated in FIG. 4, the movable position defining member 54 is equipped with an abutting plate 55 which abuts against the leading edges of the documents, and is connected to one end of a joint member 57 rotatably supported around a supporting shaft 56. The other end of the joint member 57 is coupled with a solenoid 58.

When no signal is input to the solenoid 58, the plunger on the solenoid 58 projects outward and the abutting plate 55 is disposed at the normal position, indicated by a solid line in FIG. 4. When a signal is sent to the solenoid 58, the plunger is drawn into the solenoid 58, so that the joint member 57 is rotated clockwise (as viewed in FIG. 4) around the supporting shaft 56. In conjunction with this rotation, the abutting plate 55 is moved downstream (the upper direction in FIG. 4), and is placed at a paper release position indicated by the dashed line in FIG. 4.

The distance between the normal position of the abutting plate 55 and the fixed position defining member 53 is substantially equal to the length of an A4-sized sheet of paper. The distance between the normal position and the paper release position of the abutting plate 55 is substantially equal, or slightly longer than, the distance between the discharge roller 51 and the fixed position defining member 53 in the paper transport direction. The movable position defining member 54 is arranged such that when the trailing edge of a document is released from the discharge roller 51, the solenoid 58 is turned ON and the abutting plate 55 is placed in the paper release position.

A release roller 59 is provided above the stacking tray 52, and serves to feed paper downstream as each document is discharged from the discharge roller 51. The release roller 59 is supported by a support member 60 rotatable in the direction shown by "A" in FIG. 3. When the trailing edge of each document is released from the discharge roller 51, the release roller 59 is lowered down to abut against the documents on the stacking tray 52.

Figure 5:
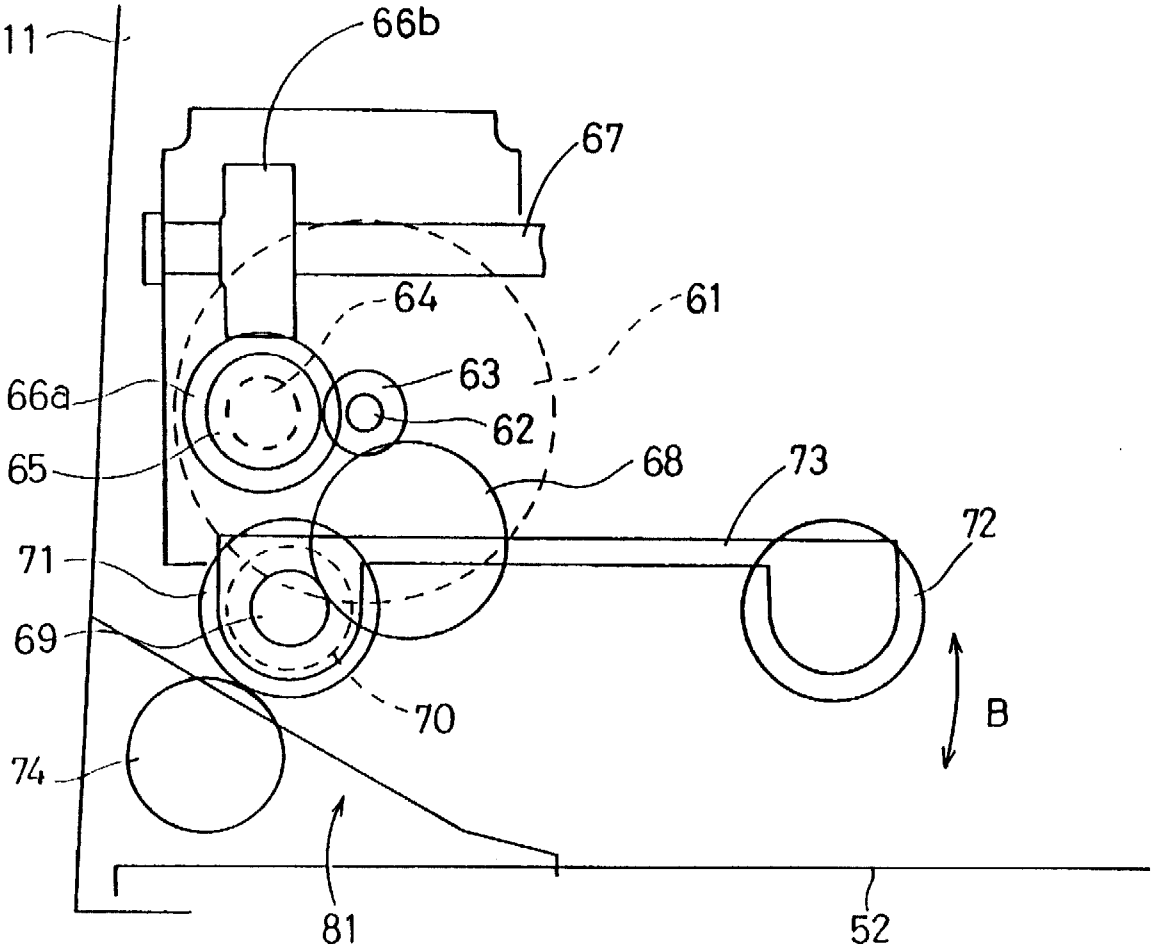
FIG. 5 is a schematic cross-sectional view showing a portion of the printer unit depicted in FIG. 3.

As shown in FIG. 5, a motor 61 is provided in the printer unit 11, and is rotatable in both forward and reverse directions. That is, when a document is printed in the printer unit 11, the motor 61 is rotated in one direction, whereas when the document is transported from the stacking tray 52 to the copying unit 10, the motor 61 is rotated in the opposite direction.

A rotary shaft 62 extends from the motor 61, and a gear 63 is mounted thereon. The gear 63 is coaxially meshed with another gear 65 mounted on a one-way clutch 64. The gear 65 is connected via the one-way clutch 64 to a bevel gear **66*a*, and transfers its rotational force to the bevel gear 66*a*** in only one direction.

The bevel gear **66*a* is meshed with another bevel gear 66*b*. The bevel gear 66*b* is mounted on a rotary shaft 67 which extends perpendicular to the rotary shaft 62. The rotary shaft 67 transfers its drive force via the plurality of gears and belts to the paper supply roller 45, the feed roller 46, the photosensitive drum 41, the fixing device 48, the feed roller 49, the ejecting roller 51, the release roller 59**, and so on.

The gear 63 is also meshed with a gear 68, which in turn is meshed with a gear 69. The gear 69 is provided with another one-way clutch 70, and transfers its rotational force in only one direction to a paper resupply roller 71 via this one-way clutch 70.

A pick-up roller 72 is positioned above the stacking tray 52, and serves to feed paper on the stacking tray 52 to the copying unit 10. The pick-up roller 72 is coupled via either a gear or a belt with the paper resupply roller 71, and is supported by a supporting member 73 rotatable as shown by "B" in FIG. 5. When the paper on the stacking tray 52 is to be transported to the copying unit 10, the pick-up roller 72 descends and abuts against the paper. A separating roller 74 abuts against the paper resupplying roller 71, and counter-rotates with respect to the paper resupplying roller 71 so as to prevent two sheets of paper from being sent to the copying unit 10 at the same time.

Figure 6:
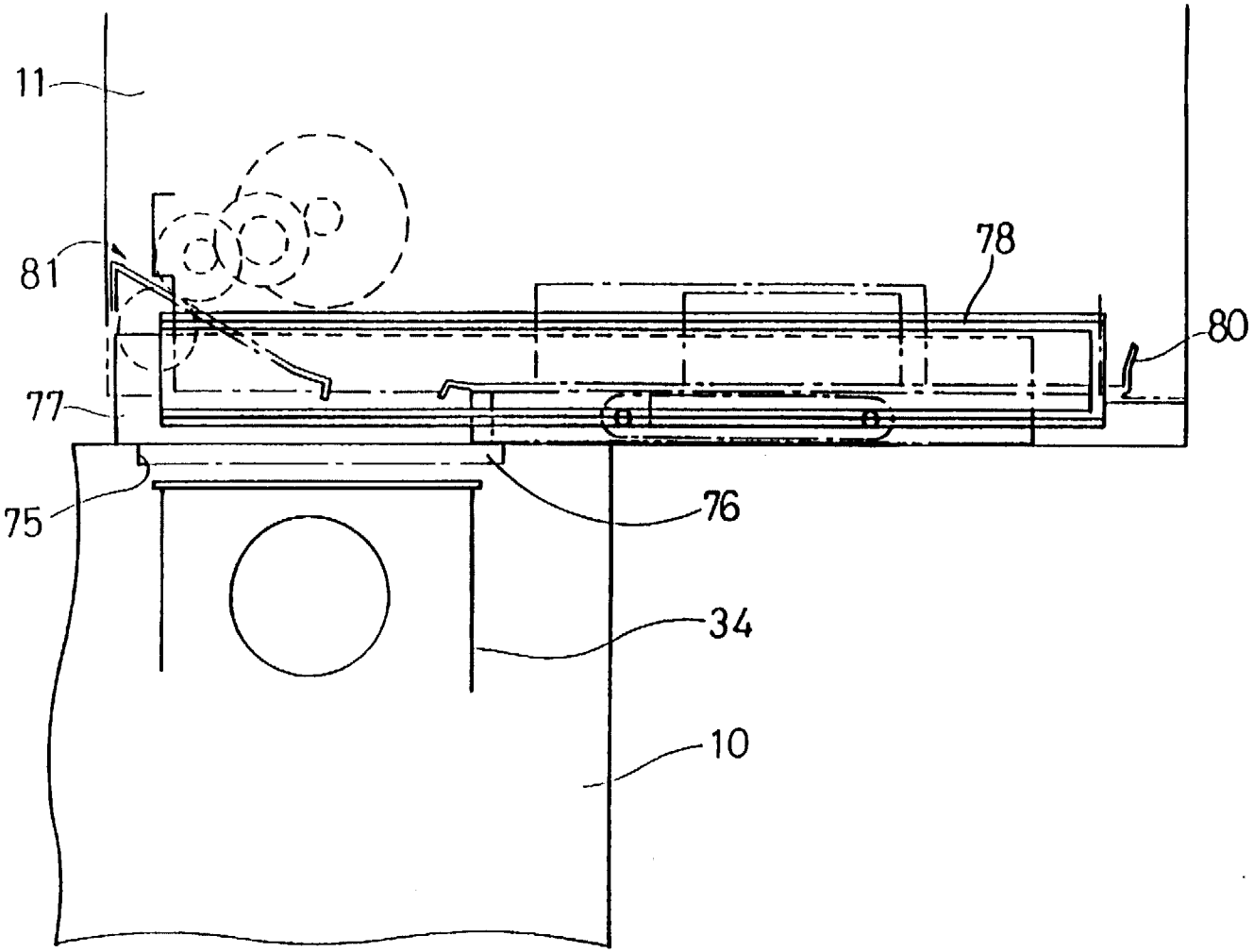
FIG. 6 shows a transport mechanism for the printer unit depicted in FIG. 3.

As shown in FIG. 6, an opening 75 is formed in the copying unit 10, and allows one to gain access to the toner cartridge 34. A lid 76 is mounted on the opening 75, which allows it to be opened and closed. A guide member 77 is mounted on an upper surface of the copying unit 10, and serves to guide the printer unit 11 between a normal position shown in FIG. 6, in which it is adjacent to the document transport device 14 of the copying unit 10, and a saving position shown in FIG. 7, in which it is separated from the document transport device 14. The guide member 77 is engaged with a guided member 78 disposed on the lower portion of the printer unit 11.

Figure 7:
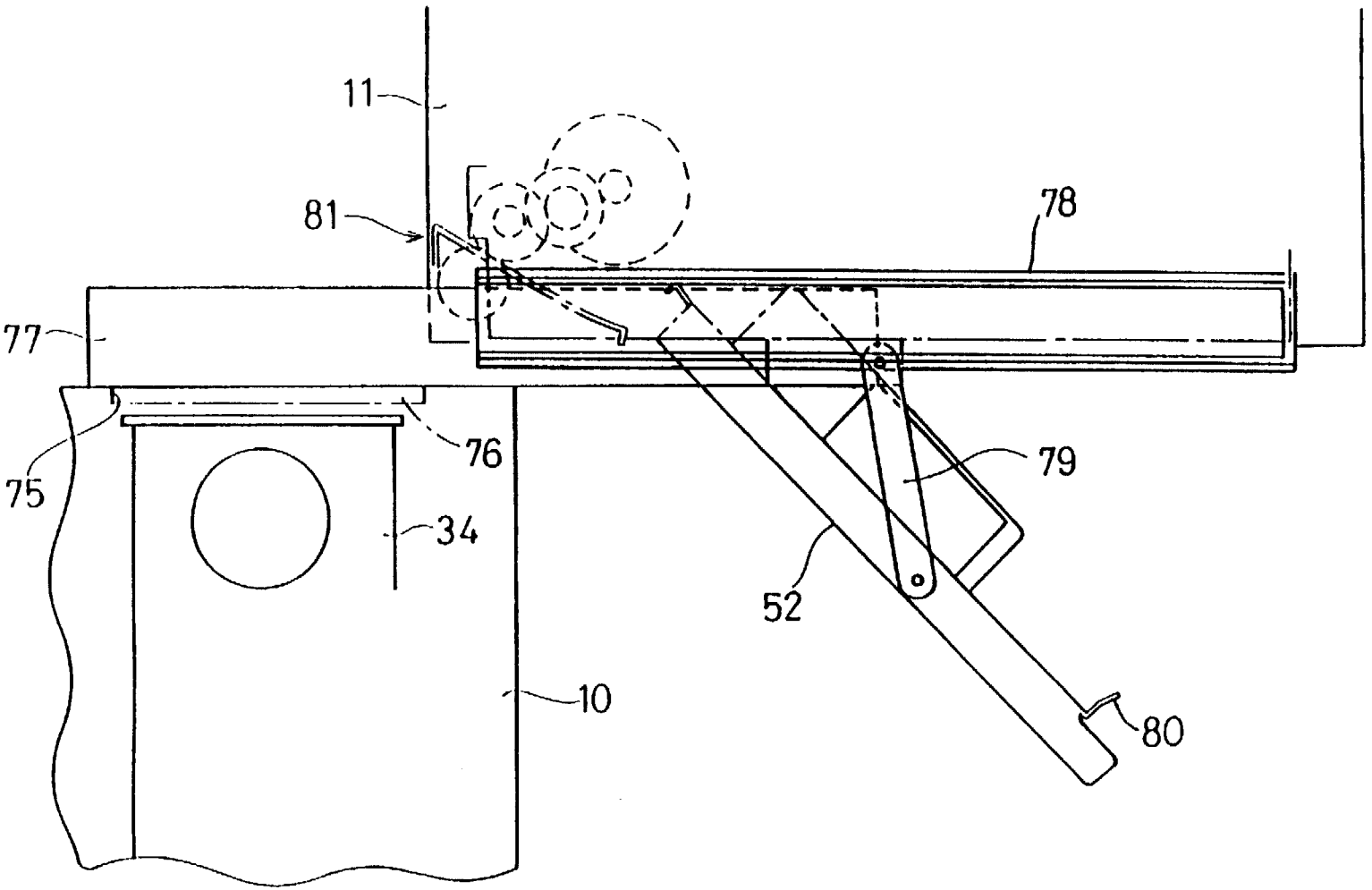
FIG. 7 shows the transport mechanism for the printer unit depicted in FIG. 6, configured for toner cartridge removal.

As shown in FIG. 6, when the printer unit 11 is in the normal operating position, the opening 75 in the copying unit 10 is under the printer unit 11. As shown in FIG. 7, when the printer unit 11 is in the saving position, the opening 75 is exposed, and thus the lid 76 may be opened and the toner cartridge 34 replaced.

The stacking tray 52 of the printer unit 11 is coupled with the main body of the printer unit 11 such that the stacking tray 52 can be opened downward by means of a joint portion 79. An engaging piece 80 is provided at the tip of the stacking tray 52, and when engaged with an upper portion of the printer unit 11, allows the stacking tray 52 to be maintained in the normal operating position. When the lower surface of the stacking tray 52 is pivoted downward, the printer unit 11 is moved to the saving position. As a result, when a paper jam occurs on the stacking tray 52 or the paper resupply path 81, jammed papers can be easily removed.

As shown in FIG. 2, the document transport device 14 in the copying unit 10 is equipped with an document mounting unit 82. A paper supply roller 83 and a separating belt 84 are disposed on the downstream side (the left side in FIG. 2) of the document mounting unit 82. The paper supply roller 83 transports documents from the document mounting unit 82. The separating belt 84 is tensioned by a plurality of rollers, and is rotated in a direction counter to that of the paper supply roller 83, so as to avoid feeding more than one document at a time into the copying unit 10.

An document transport path 85 is provided further downstream, is generally U-shaped, and serves to guide documents from the document mounting unit 82 to the document reading unit 12. A belt 86 is disposed downstream from the document transport path 85, and is rotated by a plurality of rollers.

Figure 8:
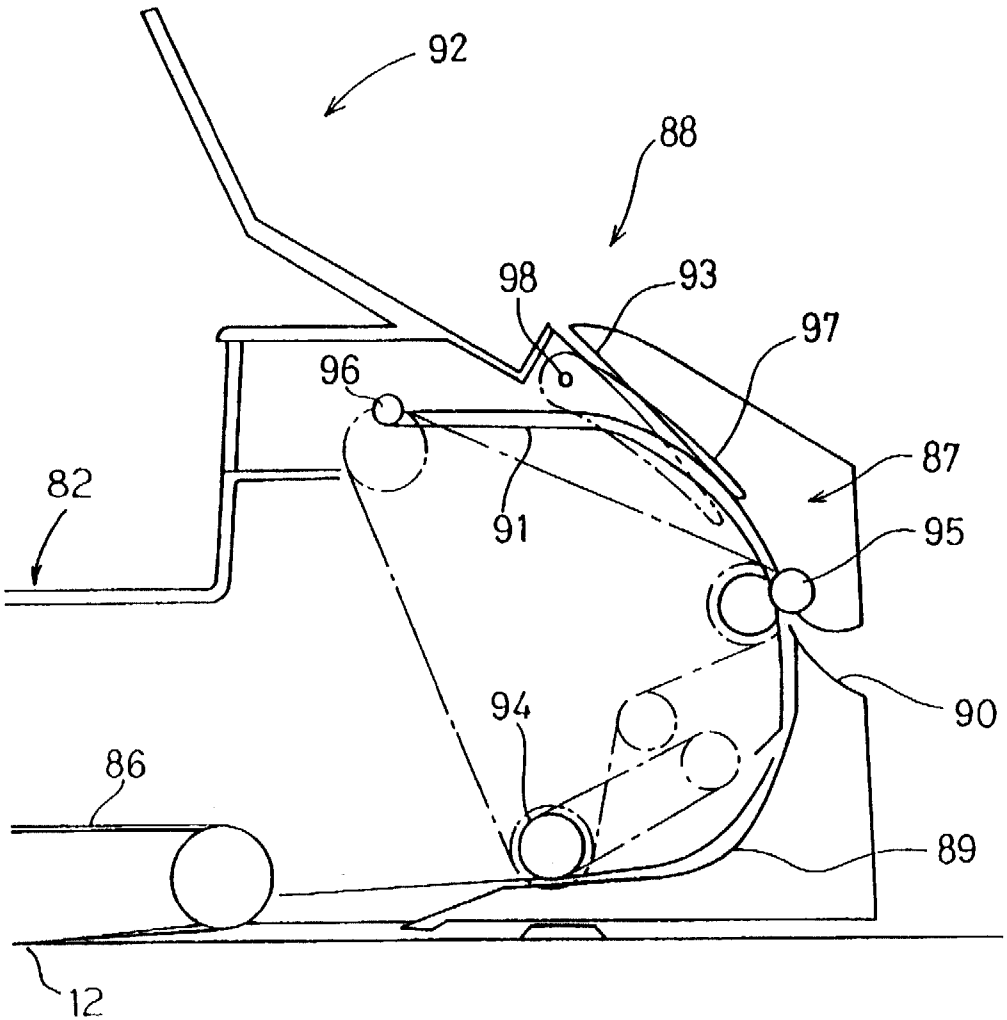
FIG. 8 is a schematic cross-sectional view showing a portion of a document transport device disposed in the image forming device depicted in FIG. 2.

The document transport device 14 further includes a document return unit 88. As shown in FIG. 8, the document return unit 88 includes a document transport path 87, which in turn includes a document return path 89, a document supply path 90, a document mounting path 91, and a document discharge path 93. The document supply path 90 is a continuation of the paper resupply path 81 in the printer unit 11. The original document transport path 87 also includes a plurality of rollers 94, 95, and 96, which are driven by drive sources (not shown).

The document mounting path 91 and the document discharge path 93 branch out from the document return path 89, and a branching claw 97 is provided at the point in which they branch. The branching claw 97 is pivotably supported around a support shaft 98, and thus is movable between the position indicated by a solid line in FIG. 8, and another position indicated by a dashed line in FIG. 8.

When a document is transported through either the document supply path 90 or the document return path 89, and the branching claw 97 is arranged at the position indicated by a solid line in FIG. 8, the document travels via the document mounting path 91 to the document mounting unit 82. On the other hand, when a document is transported through the document return path 89 and the document discharge path 93 to a discharge tray 92, the branching claw 97 is arranged at the position indicated by a dashed line in FIG. 8. As a consequence, the document can be selectively sent to either the discharge tray 92 or the document mounting unit 82.

Figure 9:
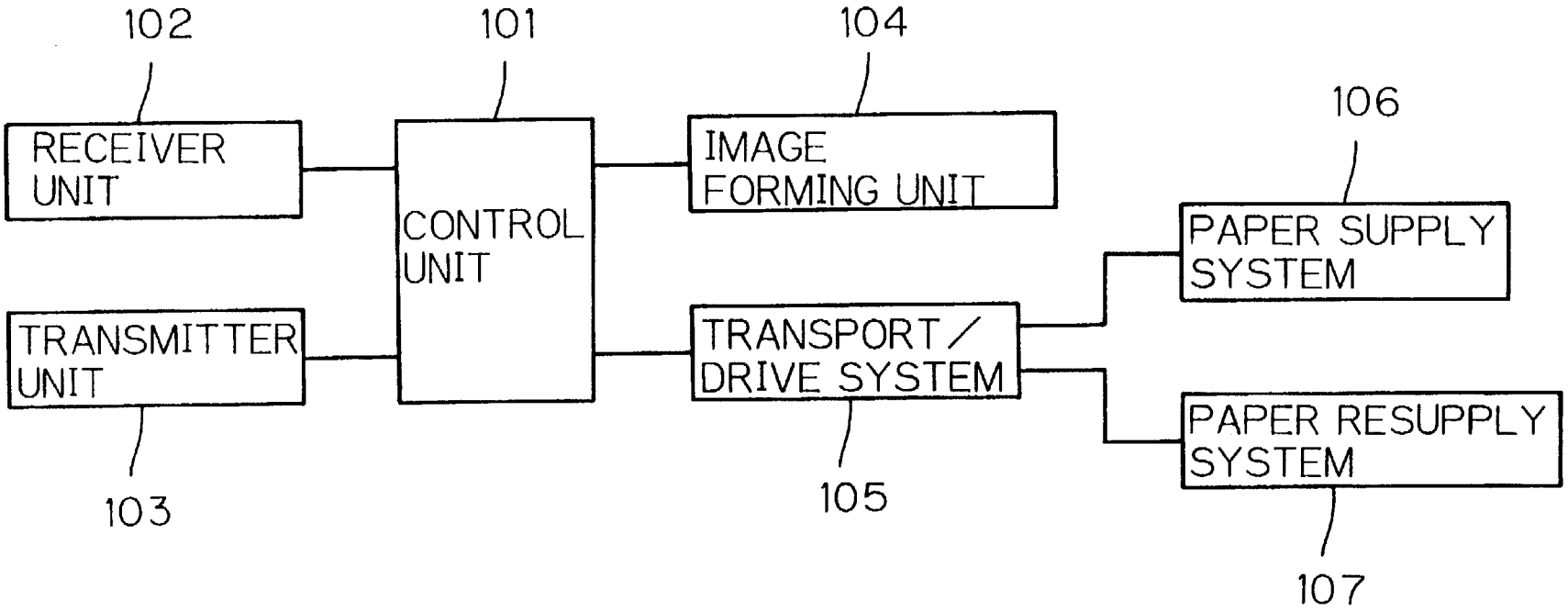
FIG. 9 is a control block diagram showing the overall arrangement of the printer depicted in FIG. 3.

As shown in FIG. 9, the control system for the printer unit 11 includes a control unit 101. The control unit 101 includes a microcomputer system containing a CPU, ROM, RAM, and the like (not shown). A receiver unit 102 is connected to the control unit 101, and receives image data and image process control data sent from the data processing device 2. A transmitter unit 103 is connected to the control unit 101, and transmits image process control data received by the receiver unit 102 to the copying unit 10.

An image forming unit 104 containing the photosensitive drum 41, the developing device 42, and a laser unit (not shown) is connected to the control unit 101. A transport/drive system 105 is connected to the control unit 101, and sequentially transports paper from the paper supply cassette 43 to the photosensitive drum 41 and the stacking tray 52, and also sequentially transports printed documents from the stacking tray 52 to the copying unit 10. The transport/drive system 105 includes the motor 61 and the various gears shown in FIG. 5. A paper supply system 106 is connected to the transport/drive system, and includes the discharge roller 51, the movable position defining member 54 and the release roller 59. A paper resupply system 107 is also connected to the transport/drive system, and includes the pick-up roller 72, the paper resupply roller 71, and the separating roller 74.

Figure 10:
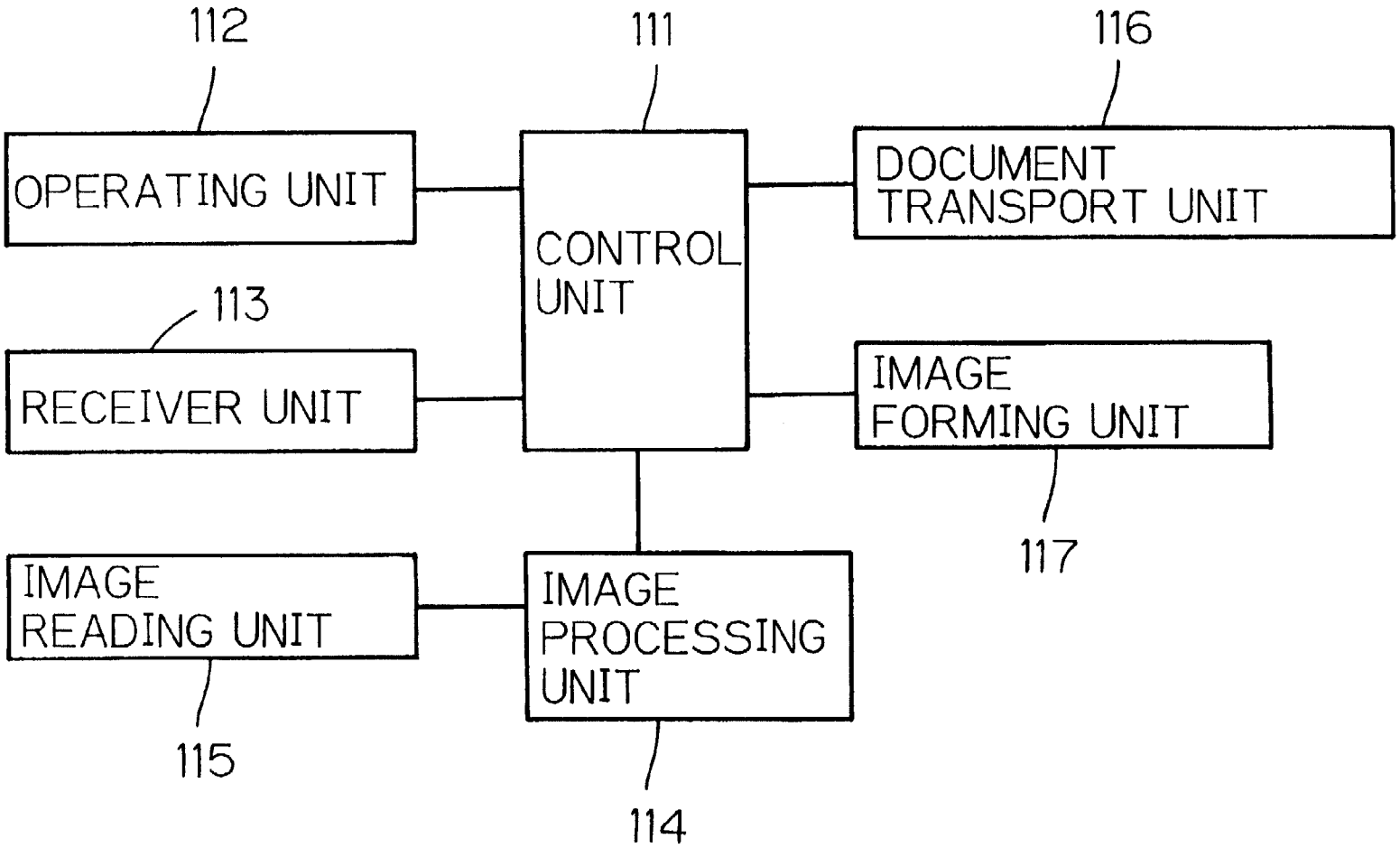
FIG. 10 is a control block diagram showing the overall arrangement of a copying unit disposed in the image forming device depicted in FIG. 2.

As shown in FIG. 10, the copying unit 10 includes a control unit 111 having a microcomputer system containing a CPU, ROM, RAM and the like (not shown). An operating unit 112 is also connected to the control unit 111, and is disposed on an upper surface of the copying unit 10. The operating unit 112 includes a key operating unit, a liquid crystal display unit, and the like (not shown). The key operating unit (not shown) includes a print key, a ten key for setting the number of copies, an enlarging/compressing magnification selecting key, and a key for selecting other process modes.

A receiver unit 113 is also connected to the control unit 111, and receives the image process control data transferred from the printer unit 11. An image processing unit 114 and an image reading unit 115 are also connected to the control unit 111. The image processing unit 114 executes various types of image processing operations with respect to image information read by the image reading unit 115. A document transport unit 116 and an image forming unit 117 are also connected to the control unit 111. The document transport unit 116 transports documents to the image reading unit 115, and the image forming unit 117 forms an image on a sheet of paper in response to the image information read by the image reading unit 115.

Referring now to the flow chart shown in FIG. 11, the overall operation of the image forming device will now be described.

When the power supply of the image forming device is turned ON, a number of parameters are initialized at step S1. At step S2, it is determined whether instructions have been entered into the operating unit 112 of the copying unit 10. If so, the process is advanced to step S3, and copying is performed in the copying unit 10 according to those instructions.

At step S4, it is determined whether image process control data issued from the data processing device 2 has been received. If so, the process is advanced to step S5, and image data output from the data processing device 2 is processed by the printing unit 11, and if more than 1 copy is required, the copying unit 10. At step S6, other processes are carried out and then the process returns to step S2.

Figure 12:
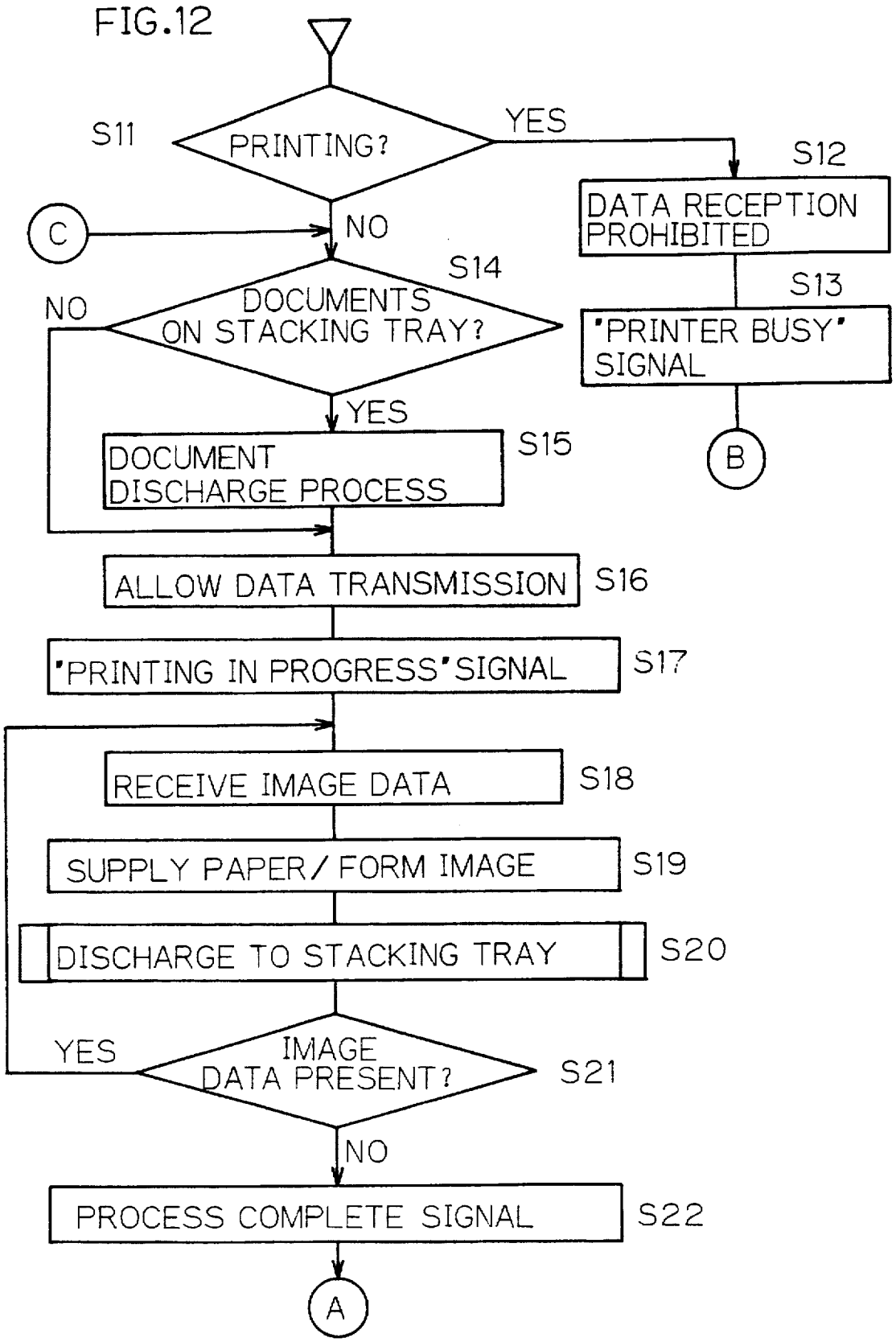
FIG. 12 is a flow chart showing the control of the printer unit depicted in FIG. 3.
Figure 13:
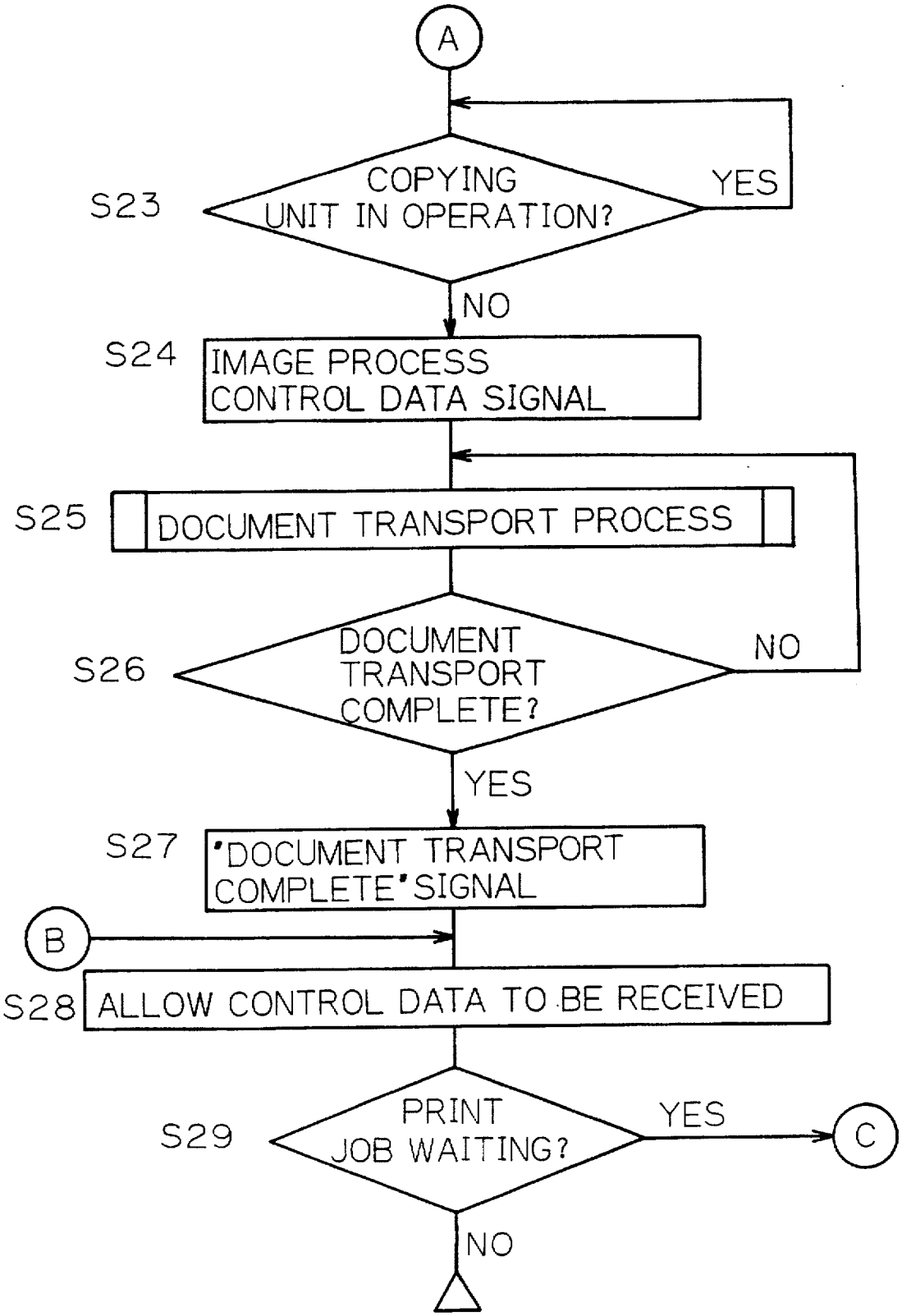
FIG. 13 is a continuation of the flow chart depicted in FIG. 12.

When image process control data issued from the data processing device 2 is received at step S4, the printer unit 11 is operated in accordance with the process shown in the flow charts of FIG. 12 and FIG. 13.

At step S11, it is determined whether the printer unit 11 is in the process of printing a document. If so, the process is advanced to step S12, and image data from the data processing device 2 is prohibited from being received by the printer unit 11. At step S13, a signal informing the user that printing is in progress is output to the data processing device 2, and at the same time, data indicating that the data processing device 2 is waiting to send image data is placed into RAM. Thereafter, the process is advanced to step S28.

If it is determined at step S11 that the printer unit 11 is not currently printing, the process is advanced to step S14. At step S14, it is determined whether any documents are present on the stacking tray 52. This can be detected by a paper detecting sensor (not shown) mounted on the stacking tray 52. If documents are detected on the stacking tray 52, the process is advanced to step S15. At step 15, if it is determined that the copying unit 10 is not in the process of copying another document, a message is sent to the data processing device 2 which sent the data, asking whether the documents on the stacking tray 52 are to be transported to the copying unit 10 or discharged from the printer unit 11. At step S16, after any documents on the stacking tray 52 have been cleared, a signal indicating that image data may be transmitted is sent to the data processing device 2 which transmitted the image process control data. At step S17, a signal indicating that the printer unit 11 is in operation is sent to the copying unit 10.

At step S18, the image data is sent from the data processing device 2 and received by the printer unit 11. At step S19, the paper supplying system 106 is driven by the transport/drive system 105 to thereby supply a sheet of paper from the paper supply cassette 43 to the photosensitive drum 41, and the image is printed onto the paper. At step S20, the document is transported via the discharge roller 51 to the stacking tray 52. It should be noted that in this embodiment the documents on the stacking tray 52 are stacked such that the images thereon are facing upward.

At step S21, it is determined whether further image data has been output from the data processing device 2. If so, the process returns to step S18, and the remaining printing is processed as above. If not, the process is advanced to step S22, and a signal indicating that printing has been completed is transmitted to the copying unit 10.

At step S23 of FIG. 13, it is determined whether the copying unit 10 is in operation. When a signal is received indicating that the copying machine 10 is not in operation, the process is advanced to step S24, and the image process control data accepted from the data processing device is sent to the copying unit 10. This image process control data contains data used to determine copy volume and various copying modes.

At step S25, documents on the stacking tray 52 are sequentially fed from the top of the stack to the document transport device 14 of the copying unit 10. At step S26, it is determined whether all of the documents on the stacking tray 52 have been transported to the copying machine 10. If not, the process is returned to step S25 and the document transport process is continued. If it is determined that there are no documents remaining, the process is advanced to step S27, and a signal indicating that the document transport process has been completed is sent to the copying unit 10. At step S28, the image forming device 1 is again allowed to receive control data output from the data processing device 2, and at step S29 it is determined whether a print job waiting signal is stored in memory at step S13. If so, the process is returned to step S14. If not, the process in the printer unit 11 is completed.

Figure 14:
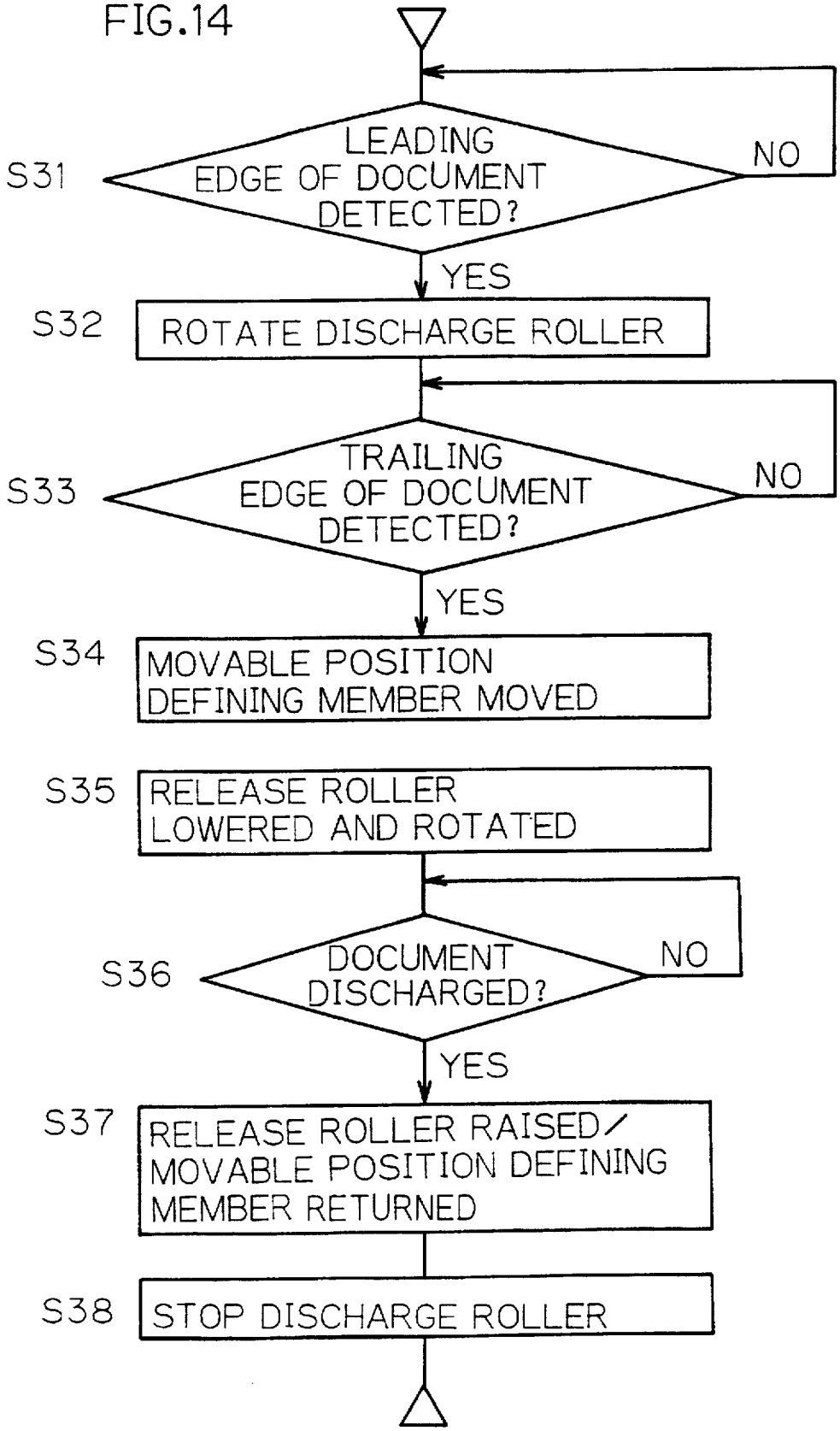
FIG. 14 is a flow chart showing the operation of a document discharge method in the printer unit depicted in FIG. 3.

Details of the document discharge process mentioned in step S20 are shown in the flow chart of FIG. 14.

At step S31, it is determined whether the leading edge of an document fed via the discharge paper path 50 has reached the discharge roller 51. The leading edge of an document is detected by means of a paper detecting sensor (not shown) mounted near the upstream side of the discharge roller 51. If the leading edge of the document has reached the discharge roller 51, the process is advanced to step S32, and the discharge roller 51 is rotated by means of the motor 61 and the one-way clutch 64 shown in FIG. 5. At this time, the drive force of the motor 61 is not transferred by the one-way clutch 70 to the paper resupply system 107. As a result, both the paper resupply roller 71 and the pick-up roller 72 are not rotated. The abutting plate 55 on the movable position defining member 54 is placed at the normal position indicated by the solid line of FIG. 4, and the release roller 59 is lifted off the stacking tray 52.

At step S33, a paper detecting sensor (not shown) determines whether the trailing edge of the document has reached the discharge roller 51. If so, the process is advanced to step S34, and the movable position defining member 54 is moved downstream when a drive signal is input to the solenoid 58 (indicated by the dashed line in FIG. 4). At step S35, the release roller 59 is lowered so that the peripheral surface thereof abuts against the document on the stacking tray 52, and is then rotated in the paper transport direction.

At step S36, it is determined whether the document has been discharged. In this embodiment, if a paper detection sensor disposed near the downstream side of the ejecting roller 51 (not shown) detects that the trailing edge of the document has been released from the discharge roller 51, then the discharge of the document to the stacking tray 52 has been completed and the process is advanced to step S37.

At step S37, the release roller 59 is raised so that it is separated from the document on the stacking tray 52, and the abutting plate 55 of the movable position defining member 54 is returned to the normal position (indicated by the solid line in FIG. 4). At step S38, the discharge roller 51 is stopped.

At step S36, the discharged document is completely separated from the discharge roller 51 and placed on the stacking tray 52. Because the discharge roller 51 is disposed downstream from the fixed position defining unit 53, there is no possibility that the discharged document can be caught on the fixed position defining member 53, and/or slip under another document previously discharged. At step S37, the abutting plate 55 is returned to the normal position, so that both the leading and trailing edges of the documents on the stacking tray 52 can be accurately aligned.

Figure 15:
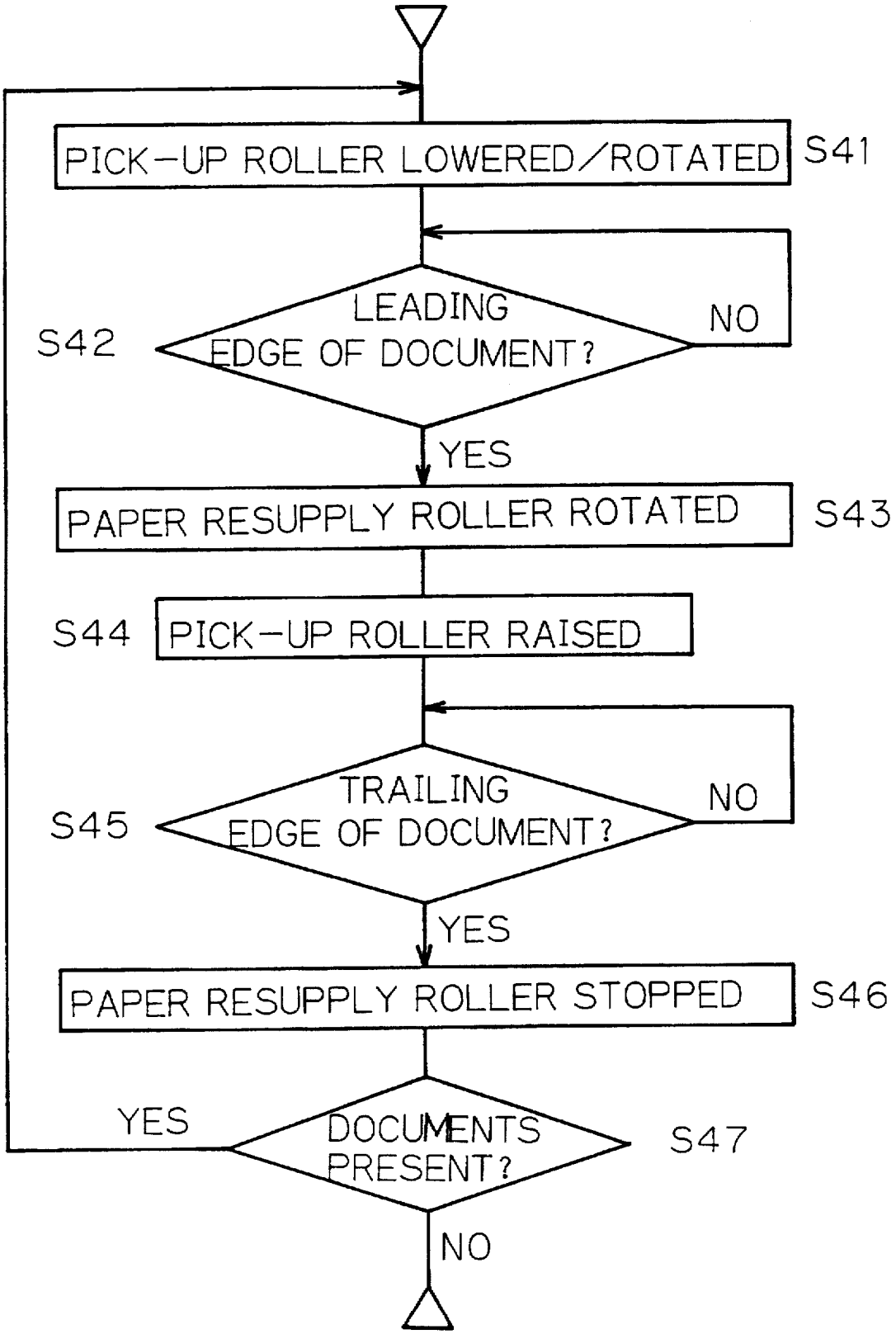
FIG. 15 is a flow chart showing a paper resupply method for the printer unit depicted in FIG. 3.

Details of the document transport process mentioned in step S25 of FIG. 13 are shown in the flow chart of FIG. 15.

At step S41, the pick-up roller 72 is lowered to abut against the documents on the stacking tray 52, and then is rotated in the paper transport direction by means of the motor 61 and the one-way clutch 70. The rotational force of the motor 61 is not transferred to the paper supplying system 106 by the one-way clutch 64.

At step S42, it is determined whether the leading edge of the document transported from the stacking tray 52 by the pick-up roller 72 has reached a position near the paper resupply roller 71. This detection is accomplished by a paper detecting sensor (not shown) disposed upstream from the paper resupplying roller 71. If the leading edge has been detected, the process is advanced to step S43. At step S43, the paper resupply roller 71 is rotated in the paper transport direction (clockwise direction) by means of the motor 61. At the same time, the separating roller 74 is rotated in a counterclockwise direction. When the paper resupplying roller 71 begins to rotate, the pick-up roller 72 is raised at step S44 and is separated from the documents on the stacking tray 52.

At step S45, a paper detecting sensor (not shown) determines whether the trailing edge of the document has passed the paper resupply roller 71. If so, the process is advanced to step S46, and the rotation of the paper resupply roller 71 is stopped. At step S47 it is determined whether there is another document on the stacking tray 52. If so, the process returns to step S41 and the document transport process is continued. When it is determined that there are no further documents on the stacking tray 52, the document transport process is ended.

It should be understood that the documents on the stacking tray 52 are arranged such that the last document printed is placed on the top of the stack. Because the documents are transported to the copying unit 10 in sequence, starting with the uppermost one, the first document printed will be at the top of the stack on the document mounting unit 82. Accordingly, because the documents are transported by the document transport device 14 sequentially from the bottom of the stack, the page sequence of the document produced by the copying unit 10 will correspond to the page sequence of the document sent from the data processing device 2.

The document transport path of the paper resupply system 107 is perpendicular to the paper transport path of the paper supply system 106. This allows a relatively low-cost printer unit 11 to be used, because it is not necessary for the printer unit 11 to be able to adjust the position of the documents in order to be transported into the copying machine 10. Moreover, because the rotational forces of the motor 61 are transferred via the one-way clutches 64 and 70, both systems can be driven by a single motor, and thus the amount space needed for the motor 61 and power consumption can be reduced.

Figure 11:
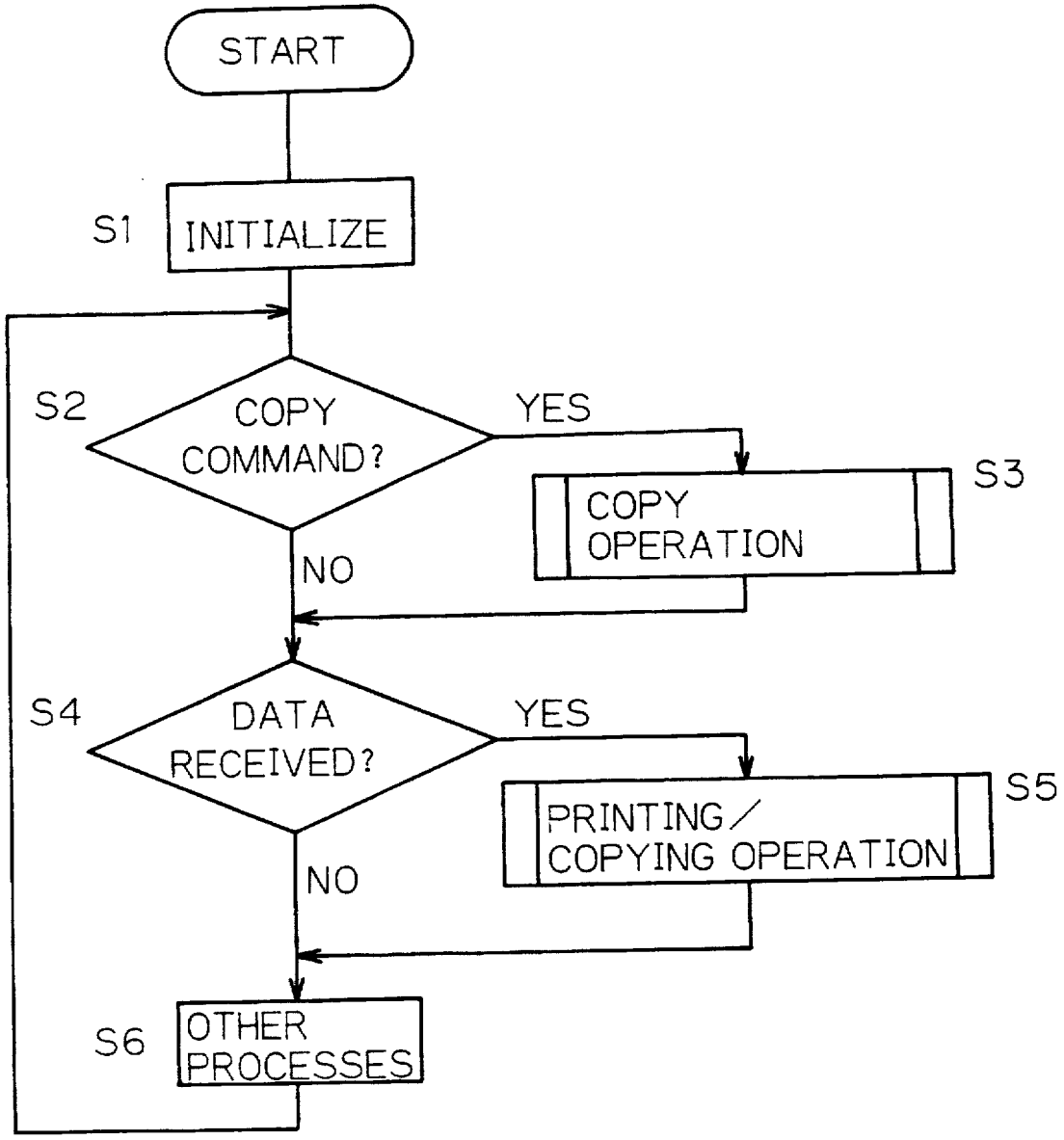
FIG. 11 is a flow chart showing the overall control of the image forming device depicted in FIG. 2.
Figure 16:
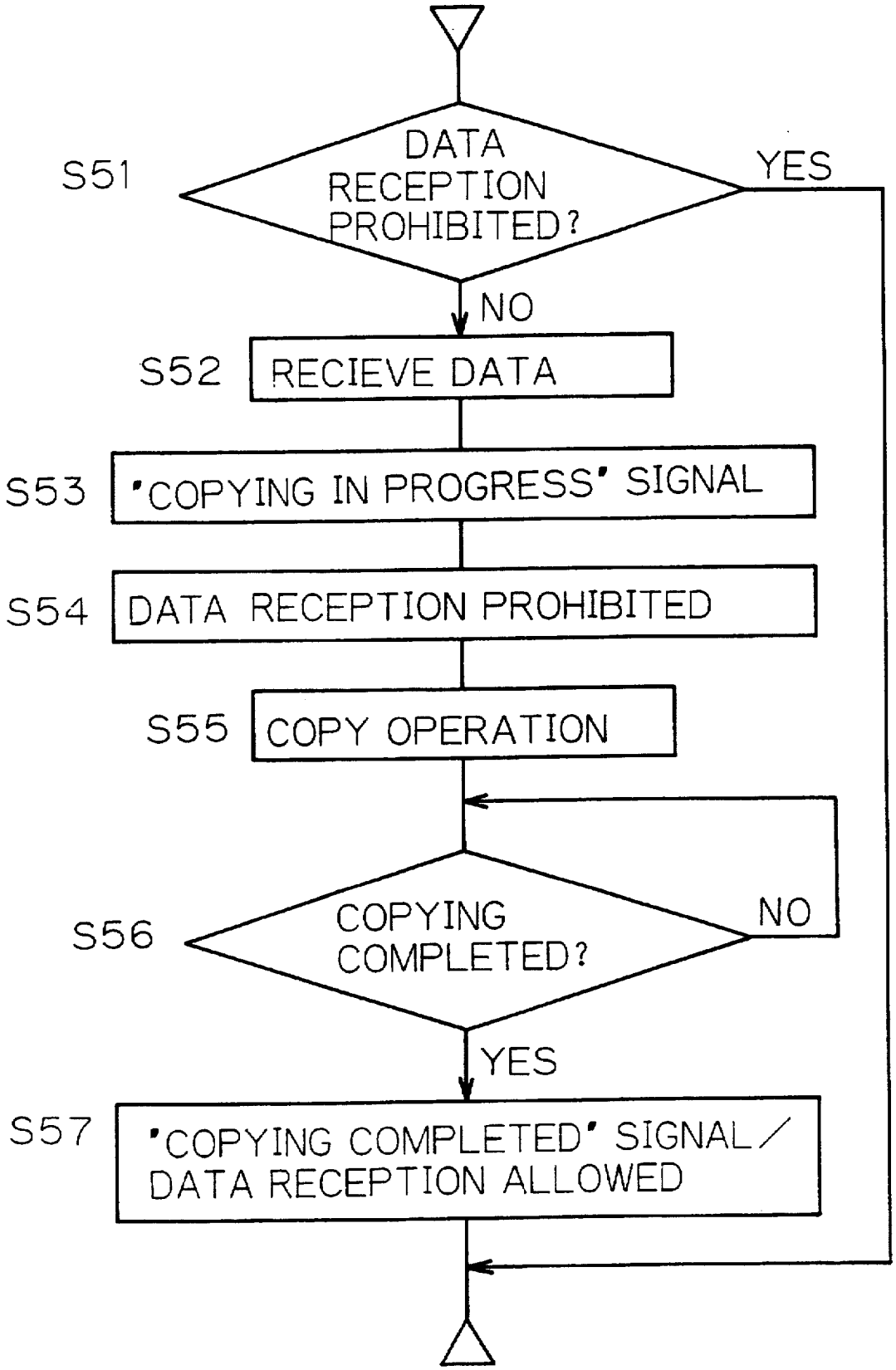
FIG. 16 is a flow chart showing normal copying procedures for the image forming device depicted in FIG. 2.

FIG. 16 is a flow chart showing details of the normal copying operation of the copying unit 10 in step S3 of FIG. 11.

At step S51, it is determined whether the copying unit 10 has been prohibited from receiving input from the operating unit 112. This occurs if the copying unit 10 is in operation, or if documents are being transported from the printer unit 11 to the document mounting unit 82. If so, the process is returned to the main routine. If not, the process is advanced to step S52, and input from the key input unit on the operating unit 112 is accepted. At step S53, a signal indicating that the copying unit 10 is operating is transmitted to the printer unit 11, and at step S54 input from the operating unit 112 is prohibited. At step S55, normal copying is carried out based on the conditions entered from the operating unit 112. At this time, the branching claw 97 on the document return unit 88 of the document transport device 14 is placed at the position indicated by the solid line in FIG. 8, so that documents in the document return path 89 are sent to the document mounting unit 82.

At step S56, it is determined whether copying has been completed based on the input received at step S52. If so, the process is advanced to step S57, a signal indicating that copying has been completed is transmitted to the printer unit 11, and the operating unit 112 is again allowed to accept data.

Figure 17:
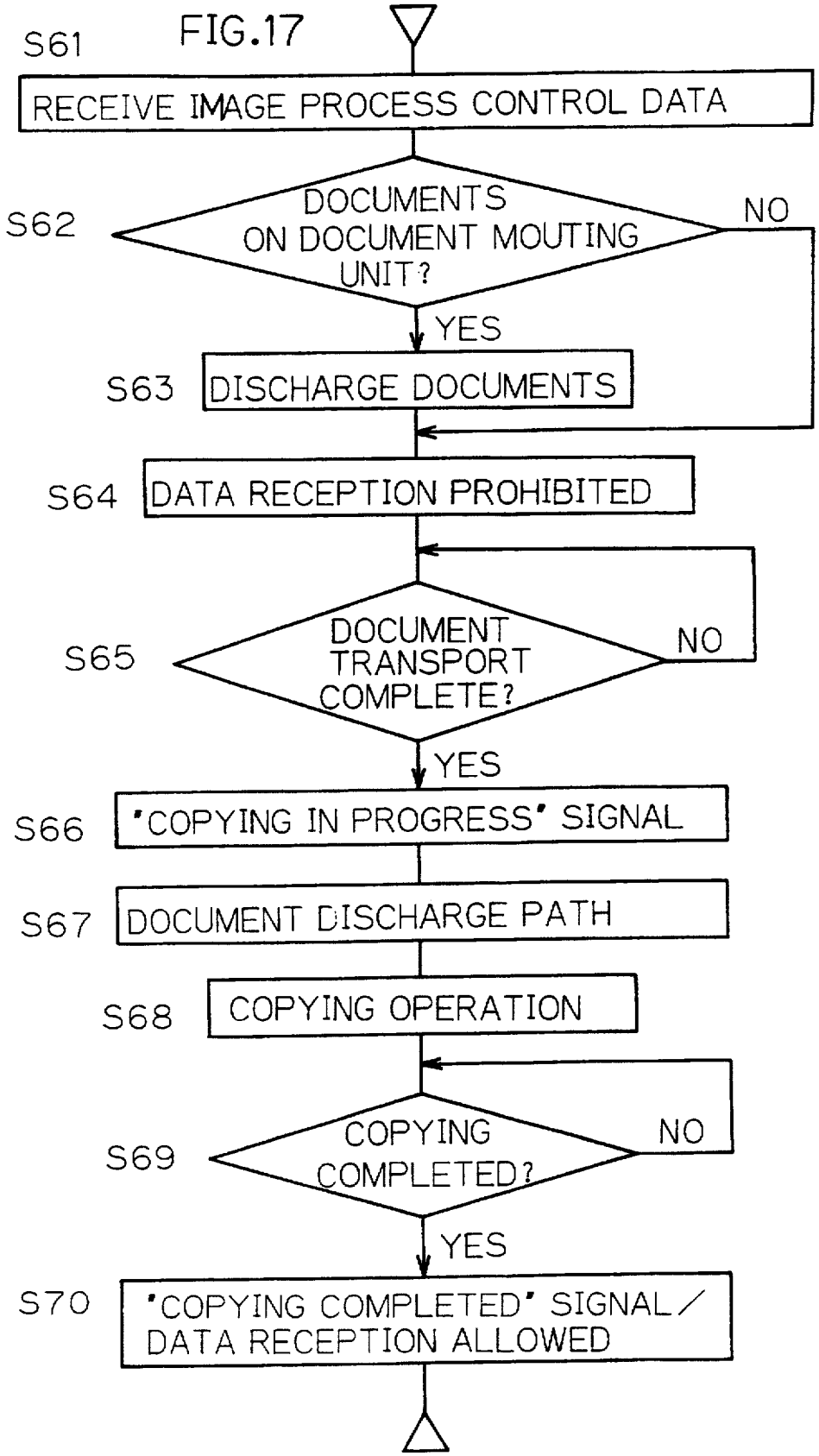
FIG. 17 is a flow chart showing the procedures for copying a document transferred from the printer unit depicted in FIG. 3.

The copying of documents printed in the printer unit 11 will now be described with reference to the flow chart of FIG. 17.

At step S61, image process control data transmitted from the printer unit 11 is received by the copying unit 10. At step S62, it is determined whether any documents are on the document mounting unit 82. If so, the process is advanced to step S63, the branching claw 97 in the document return unit 88 is placed at the position indicated by a dashed line in FIG. 8, and those documents are transported through the document transport device 14, and discharged via the document discharge path 93 to the document discharge tray 92.

At step S64, input from the operating unit 112 is prohibited, and the documents from the printer unit 11 are fed to the document mounting unit 82. At this time, the branching claw 97 of the original returning unit 88 is placed at the position indicated by the solid line in FIG. 8. At step S65, it is determined whether the document transport operation from the printer unit 11 has been completed. This is determined by whether the signal described at step S27 of FIG. 13 has been received. If so, the process is advanced to step S66.

At step S66, a signal indicating that copying is underway is transmitted to the printer unit 11. At step S67, the branching claw 97 of the original returning unit 88 is placed at the position indicated by a dashed line in FIG. 8.

At step S68, the documents on the document mounting unit 82 are sequentially fed onto the document reading unit 12 via the document transport path 85, copying is carried out based on the image process control data, and the documents are then discharged onto the document discharge tray 92. When the documents are placed on the document mounting unit 82, they are arranged such that the first document printed by the printer unit 11 is on the top of the stack face up. When copying begins, the documents on the document mounting unit 82 are fed to the document reading unit 12 beginning with the lowermost document in the stack. As a consequence, copies produced in the copying unit 10 are discharged in the same order.

At step S69, it is determined whether copying has been completed. If so, the process is advanced to step S70, and a signal indicating that copying has been completed is transmitted to the printer unit 11, and the operating unit 112 is again allowed to receive data.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image forming device connected to at least one data processing device configured for processing image data and image process control data, comprising:

a printer unit for printing documents in accordance with said image data while transporting said documents in a first direction;

a document stacking means for sequentially discharging and stacking said documents to a document stacking unit after being printed;

a first document transport means for transporting said documents in said document stacking unit in a second direction different from said first direction and aligning said documents at a document mounting unit;

a second document transport means for sequentially transporting said documents on said document mounting unit to a document reading unit in said second direction; and a copying unit for reading image data from said documents transported to said document reading unit, and forming copies of said documents in accordance with said image process control data output from said data processing device.

2. An image forming device as in claim 1, wherein said first direction in which said documents are transported in said printer unit corresponds to a length of said documents, and said second direction in which said documents are transported by said first document transport means and said second document transport means corresponds to a width of said documents.

3. An image forming device as in claim 1, wherein said first document transport means sequentially transports said documents from said document stacking unit in an order opposite that which said second document transport means sequentially transports said documents from said document mounting unit.

4. An image forming device as in claim 3, wherein:

said document stacking means stacks said documents printed in said printer unit such that the image formed thereon is facing upward;

said first document transport means sequentially transports said documents from said document stacking unit to said document mounting unit from an uppermost document on said document stacking unit; and said second document transport means sequentially transports said documents from said document mounting unit to said document reading unit from a lowermost document on said document mounting unit.

5. An image forming device having a first image forming unit which prints documents while transporting said documents in a first direction, and a second image forming unit which copies images printed on said documents while transporting said documents in a second direction different from said first direction, said image forming device comprising:

a document stacking unit for sequentially stacking documents discharged from said first image forming unit;

a fixed position defining member disposed on said document stacking unit for positionally defining a trailing edge of said documents in said first direction;

a discharge member disposed a predetermined distance from said fixed position defining member in a first discharge direction, for discharging said documents to said document stacking unit;

a movable position defining member disposed downstream from said document stacking unit in said first direction, for positionally defining a leading edge of said documents;

a defining member driving means for moving said movable position defining member when said documents are discharged by said discharge member; and a discharge mechanism for transporting said documents stacked on said document stacking unit in said second direction to said second image forming unit.

6. An image forming device as in claim 5, wherein:

said movable position defining member is moved between a first position and a second position, said first position separated from said fixed position defining member by a length of said documents in said first direction, and said second position disposed a distance away from said first position, said distance equal to a distance between said discharge member and said fixed position defining member in said first direction; and said defining member driving means places said movable position defining member at said second position when said documents are discharged by said discharge member, and places said movable position defining member at said first position after said documents have been discharged from said discharge member.

7. An image forming device as in claim 5, further comprising:

a release roller, said release roller brought into contact with said documents discharged from said discharge member and rotated in said first direction as said documents are discharged from said discharge member.

8. An image forming device as in claim 5, wherein:

said image forming device is connectable with at least one data processing device that is configured for processing image data and image process control data;

said first image forming unit is a printer unit for printing documents in accordance with said image data output from said data processing device; and said second image forming unit is a copying unit which reads image data on documents transported from said printer unit and forms copies thereof in accordance with said image process control data output from said data processing device.

9. An image forming device as in claim 1, wherein said first direction corresponds to a length of said documents, and said second direction corresponds to a width of said documents.

10. An image forming device having a first image forming unit for forming images on documents, and a second image forming unit for forming images in accordance with images formed on documents in said first image forming unit, said image forming device comprising:

a first transport means for transporting paper to said first image forming unit in a first direction, and for discharging documents formed in said first image forming unit in said first direction;

a document stacking unit for sequentially stacking documents discharged from said first transport means;

a second transport means for transporting documents from said document stacking unit to said second image forming unit in a second direction different from said first direction;

drive means for driving said first transport means and said second transport means; and a drive force transferring means configured for transferring drive force from said drive means to said first transport means and said second transport means.

11. An image forming device as in claim 10, wherein said first direction corresponds to a length of said documents and said second direction corresponds to a width of said documents.

12. An image forming device as in claim 10, wherein when said drive force from said drive means is transferred to one of said first transport means or said second transport means, said drive force transferring means does not transfer said drive force from said drive means to the other of said first transport means or said second transport means.

13. An image forming device as in claim 12, wherein: said drive means is a motor operable in both a forward direction and a reverse direction;

when said motor is operated in said forward direction, said drive force transferring means transfers said drive force of said motor to one of said first transport means or said second transport means; and when said motor is operated in said reverse direction, said drive force transferring means transfers said drive force of said motor to the other of said first transport means or said second transport means.

* * * * *